US005184380A

United States Patent [19]

Benz et al.

[11] Patent Number: 5,184,380

[45] Date of Patent: Feb. 9, 1993

[54] METHOD AND APPARATUS FOR SINGULARIZING HEALDS FOR WARP THREAD DRAWING-IN MACHINE

[75] Inventors: Rico Benz, Buchs; Janos Magdika, Trübbach, both of Switzerland

[73] Assignee: Zellweger Uster AG, Uster, Switzerland

[21] Appl. No.: 665,155

[22] Filed: Mar. 6, 1991

[30] Foreign Application Priority Data

Mar. 6, 1990 [CH] Switzerland ..... 00706/90

[51] Int. Cl.[5] ..... D03J 1/14

[52] U.S. Cl. ..... 28/205; 28/206

[58] Field of Search ..... 28/204, 205, 206, 207, 28/208

[56] References Cited

U.S. PATENT DOCUMENTS

| | | | |
|---|---|---|---|
| 1,149,137 | 8/1915 | Hathaway et al. | 28/205 X |
| 1,215,789 | 2/1917 | Field | 28/204 |
| 3,777,339 | 12/1973 | Fleischer et al. | 28/206 |
| 4,047,270 | 9/1977 | John | 28/205 |
| 4,891,871 | 1/1990 | Tachibana et al. | 28/205 |

*Primary Examiner*—Werner H. Schroeder
*Assistant Examiner*—Bibhu Mohanty
*Attorney, Agent, or Firm*—Burns, Doane Swecker & Mathis

[57] ABSTRACT

A heald singularizing system includes a selecting member (21) for the healds (LI) fed in the form of a stack (LS). The selecting member (21) separates the frontmost heald (LI1) from the stack and makes it available for the drawing-in of the warp threads. The selecting member (21) is formed by a piston which can perform a stroke essentially transversely to the heald stack (LS), during which the heald (LI1) is displaced from the heald stack (LS) into an intermediate position (ZP). Transfer means (24) transfers the respective heald (LI1) from its intermediate position (ZP) to a transport unit (25) for taking it to its drawing-in position. All types of healds can be selected from the heald stack, and neither a special preparation of the healds nor the use of a special type of heald is necessary. The heald separation and the further removal are completely uncoupled, to permit the use of means optimally adapted to the individual functions and also to simplify considerably the rectification of faults.

28 Claims, 5 Drawing Sheets

26
42
A
16
17
43
26
40
24
41
LS
18
29
27
28
30
20
21
C
23
32
33
25
22

METHOD AND APPARATUS FOR SINGULARIZING HEALDS FOR WARP THREAD DRAWING-IN MACHINE

FIELD OF THE INVENTION

The present invention relates to apparatus and methods for singularizing healds for warp thread drawing-in machines. It is directed particularly to a system for selecting and separating individual healds from a stack of healds and making them available for the drawing-in of the warp threads.

BACKGROUND

In apparatus known hitherto, the selecting member is formed by a needle which sticks into the heald stack directly after the frontmost heald of the stack and then displaces the frontmost heald in the longitudinal direction (that is, in the feed direction) of the heald stack to the drawing-in position. The healds used are either provided with a taper at their narrow edges at the selecting point or they must have a so-called keyhole. This means that healds without tapered narrowed edges or a keyhole could not hitherto be drawn in automatically in such apparatus.

SUMMARY OF THE INVENTION

An aspect of the present invention is the provision of a universally usable device and method for singularizing healds, so as to enable all types of healds to be removed. In accordance with the invention, a selecting member is formed by a piston which can perform a stroke essentially transversely to the heald stack. During the working stroke of this piston, a heald is transported from the heald stack in a positive-locking manner into an intermediate position. In a system according to the invention, the frontmost heald is not, during the selection step, pushed further in the feed direction of the stack, as has been the case heretofore, but is rather moved laterally out of the heald stack. This means an uncoupling between the actual singularizing operation and the following removal, which enables optimally adapted means to be used for the now uncoupled operations. The apparatus is able to select all types of healds from the heald stack so that the healds need not be specially prepared. Since the selection is effected in a positive-locking manner, the healds are always fully under control.

In a preferred form of the invention, transfer means are provided for transferring the respective heald from the said intermediate position to a transport unit for transporting the healds to their drawing-in position.

This transfer means represents an interface between the actual selecting device and the transport unit and opens up the possibility of being able to interrupt the connection between selecting device and transport unit when required, for example in the event of faults.

BRIEF DESCRIPTION OF THE DRAWINGS

The invention is described in greater detail below with reference to an exemplary embodiment and the drawings, in which.

DETAILED DESCRIPTION OF PREFERRED EMBODIMENTS

Figure 1:
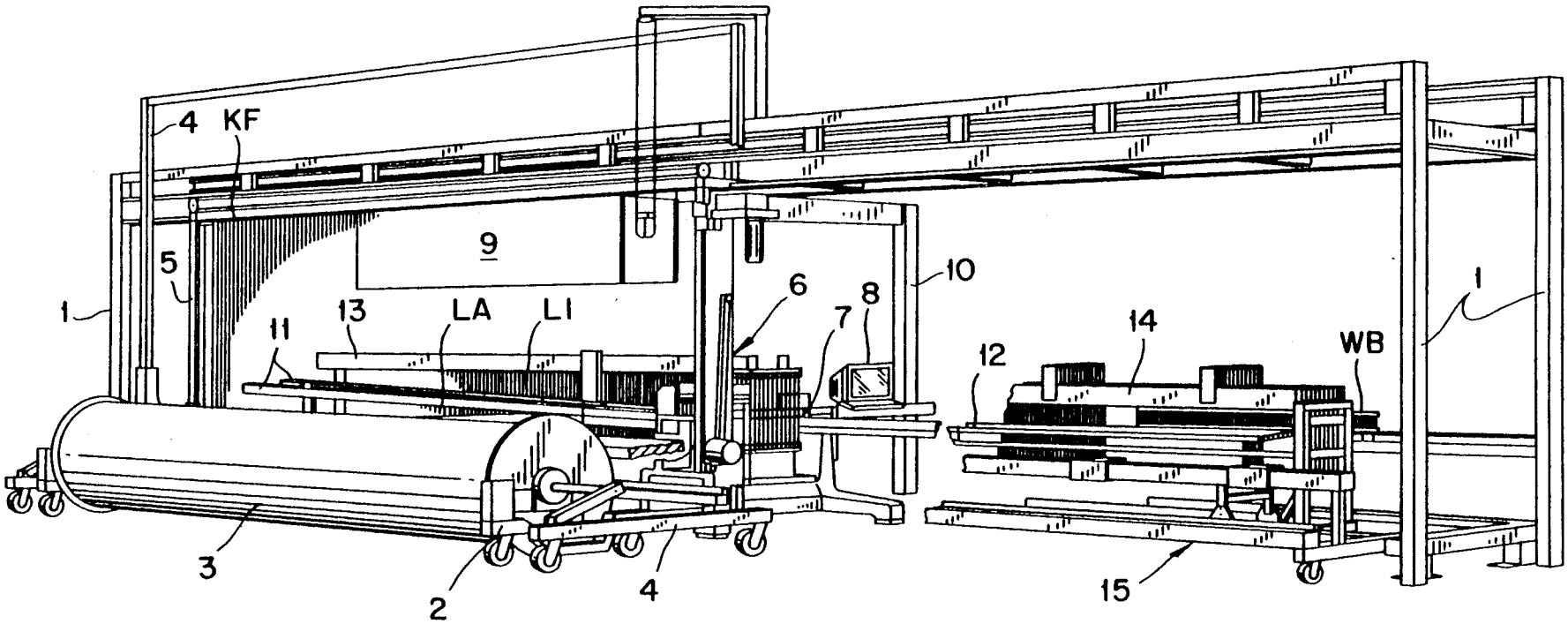
FIG. 1 shows a perspective overall representation of a drawing-in machine according to the invention.

According to FIG. 1, the drawing-in machine includes a mounting stand 1 and various subassemblies arranged in this mounting stand 1. Each of these subassemblies represents a functional module. A warp-beam truck 2 with a warp beam 3 arranged thereon can be recognized in front of the mounting stand 1. In addition, the warp-beam truck 3 contains a so-called lifting device 4 for holding a frame 5, on which the warp threads KF are clamped. This clamping is effected before the actual drawing-in and at a location separate from the drawing-in machine, the frame 5 being positioned at the bottom end of the lifting device 4 directly next to the warp beam 3. For the drawing-in, the warp-beam truck 2 together with warp beam 3 and lifting device 4 is moved to the so-called setting-up side of the drawing-in machine and the frame 5 is lifted upwards by the lifting device 4 so that it then assumes the position shown.

The frame 5 and the warp beam 3 are displaced in the longitudinal direction of the mounting stand 1. During this displacement, the warp threads KF are directed past thread-separating apparatus 6 and as a result are separated and selected. After the selection, the warp threads KF are cut off and presented to a drawing-in needle 7, which forms a component of the so-called drawing-in module. The selecting equipment employed for this operation may be of the type used heretofore in the warp tying machine sold under the designation USTER TOPMATIC by Zellweger Uster AG of Switzerland. USTER is a registered trademark of Zellweger Uster AG.

Next to the drawing-in needle 7, there is a video display unit 8, which belongs to an operating station and serves to display machine functions and machine malfunctions and to input data. The operating station, which forms part of a so-called programming module, also contains an input stage for the manual input of certain functions, such as, for example, creep motion, start-stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned (drawing-in module, yarn module, control module and programming module) are the heald, drop-wire, and reed modules.

The thread-separating apparatus 6 for presenting the warp threads KF to be acted upon by the drawing-in needle 7, and the path of movement of the drawing-in needle 7 transverse to the plane of the clamped warp threads KF, define a plane in the area of a support 10 forming part of the mounting stand 1. This plane separates the setting-up side already mentioned from the so-called taking-down side of the drawing-in machine. The warp threads and the individual elements into which the warp threads are to be drawn-in are fed at the setting-up side, and the so-called harness (healds, drop wires and reed) together with the drawn-in warp threads can be removed at the taking-down side. During the drawing-in, the frame 5 having the warp threads KF and the warp-beam truck 2 for the warp beam 3 are moved to the right past the thread-separating apparatus 6. In the course of this movement, the drawing-in needle 7 successively removes from the frame 5 the warp threads KF clamped on the latter.

When all warp threads KF are drawn in and the frame 5 is empty, the latter, together with the warp-beam truck 2, the warp beam 3 and the lifting device 4, are located on the taking-down side.

Arranged directly behind the plane of the warp threads KF are the warp-stop-motion drop wires LA. Behind the latter are the healds LI and the reed is further to the rear. The drop wires LA are stacked in hand magazines. The full hand magazines are hung in sloping feed rails 11, on which they are transported to the right towards the drawing-in needle 7. At this location they are separated and moved into the drawing-in position. Once drawing-in is complete, the drop wires LA pass on drop-wire supporting rails 12 to the taking-down side.

The healds LI are lined up on rails 13 and shifted manually or automatically on the latter to a separating stage. The healds LI are then moved individually into their drawing-in position and, once drawing-in is complete, they are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood as illustrative, since the reed, at the position shown of the frame 5, is of course located on the setting-up side.

A so-called harness truck 15 is provided on the taking-down side. This harness truck 15, together with the drop-wire supporting rails 12 fixed thereon, the heald shafts 14 and a holder for the reed, are pushed into the mounting stand 1 into the position shown. After the drawing-in, the truck 15 carries the harness having the drawn-in warp threads KF. At this moment, the warp-beam truck 2 together with the warp beam 3 is located directly in front of the harness truck 15. By means of the lifting device 4, the harness is now reloaded from the harness truck 15 onto the warp-beam truck 2, which then carries the warp beam 3 and the drawn-in harness and can be moved to the relevant weaving machine or into an intermediate store.

The mode of operation of the individual sub-assemblies is not the subject matter of the invention and is therefore not to be described further here. The functions are distributed over a plurality of modules and these modules represent virtually autonomous machines which are controlled by a common control computer. The cross connections between the individual modules run via this higher-level control computer, and there are no direct cross connections between the individual modules. If the structure of the drawing-in machine described is considered, the drawing-in machine system receives drawing-in data, control data, harness and yarn as well as energy and delivers processed operating data, status information and the drawn-in harness.

Figure 2:
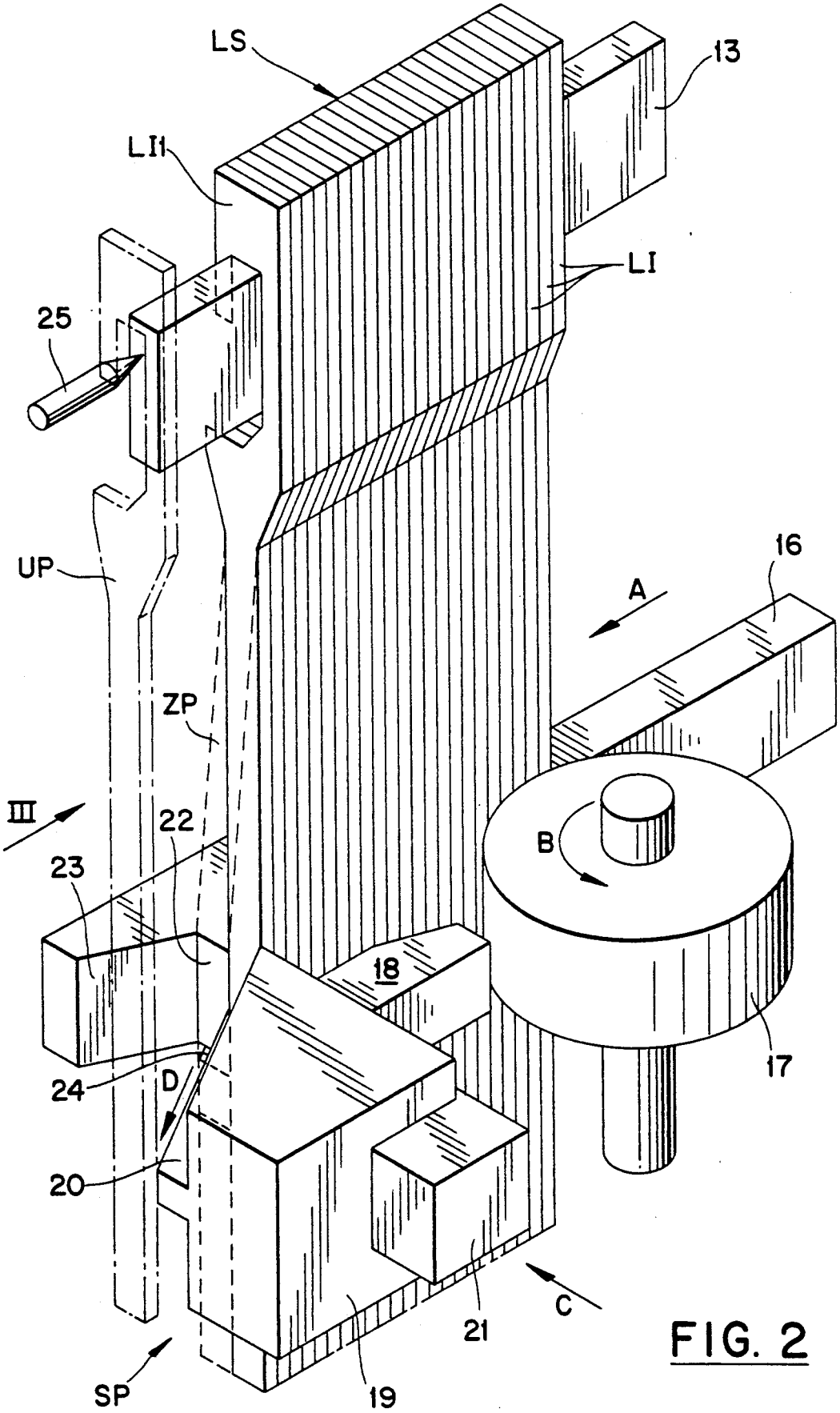
FIG. 2 shows a schematic perspective representation of the heald singularizing system in the drawing-in machine of FIG. 1.
Figure 3:
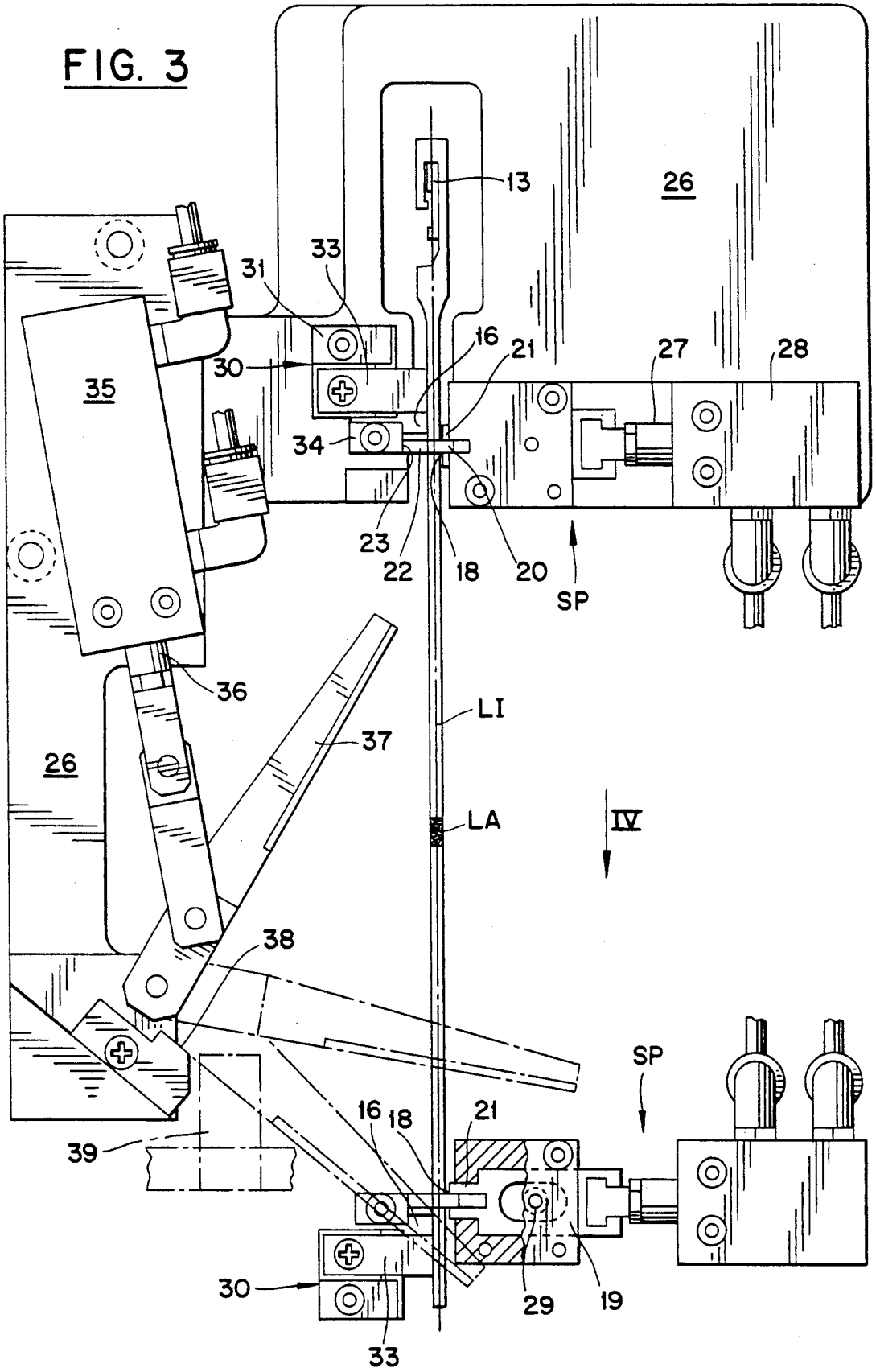
FIG. 3 is a view in the direction of arrow III in FIG. 2.
Figure 4:
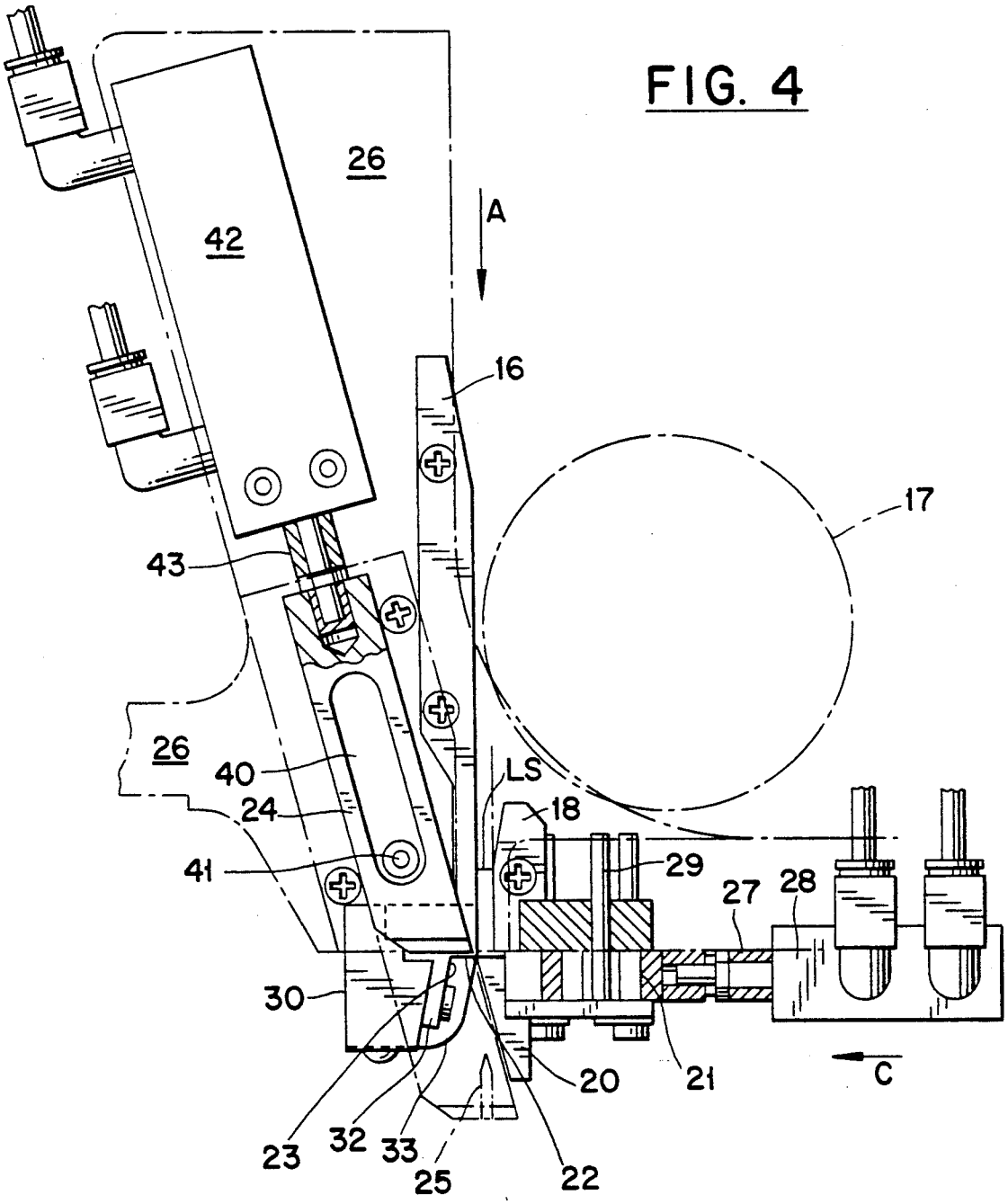
FIG. 4 is a view in the direction of arrow IV in FIG. 3.

The separating stage, designated by SP, for the healds LI is shown in FIGS. 2 to 7. FIG. 2 shows a perspective representation (not true to scale or proportion) which is intended to provide an overview of the separating principle; each of FIGS. 3 and 4 shows a view to the scale of about 1:1.

As already mentioned in the description of FIG. 1, the healds LI are lined up on rails 13 and shifted automatically or manually on the latter to the separating stage SP. The relationship between the upper lug portion of each heald LI and the upper rail 13 is shown in FIG. 2, and it will be understood that a similar relationship exists between a lower lug portion of each heald and a bottom rail which is not shown. The displacement direction of the healds along the rails 13 is designated in FIG. 2 by an arrow A.

The displacement is preferably effected automatically. For this purpose, the heald stack LS bears at one of the narrow edges of the healds LI against a guide rail 16 along which the displacement is effected. A transport means which displaces the heald stack LS in the direction of arrow A is arranged at the other narrow edge (the front edge in the figure) of the healds. According to the representation, this transport means is represented by a brush-like roller 17 which acts on the front narrow edge of the healds LI and has on its circumference a brush-like or plushy or elastic lining for driving the healds. During rotation of the roller 17 in the direction of rotation designated by an arrow B, the healds LI are pushed in the direction of arrow A. Instead of the roller 17 or in combination with the same, a conveying belt can be used. Such a belt would be stretched over two rollers and is provided either with a suitable lining or with individual, preferably brush-like, driving elements.

Directly in front of the separating stage SP, a guide rail 18 is also arranged in the area of the front narrow edge of the healds LI, which guide rail 18 has a sloping, funnel-like entry part so that the healds LI are fed in an ordered manner to the separating stage in a guide channel formed by the two guide rails 16 and 18. In the separating stage, in each case the frontmost heald LI1 of the heald stack LS is separated or selected from the latter and transferred to a transport unit which successively moves the individual healds to the drawing-in position in which the warp threads are drawn in.

Two separating stages SP are provided, of which one acts on the healds LI in their top area and the other acts on the healds LI in their bottom area (see FIG. 3). Both separating stages are driven synchronously.

With the aid of FIG. 2, in which the main parts of the separating stage SP arranged in the area of the top heald end are shown, the operating principle of the heald separation will now be explained. A stop element is arranged directly in front of the removal end of the guide channel formed by the guide rails 16 and 18, which stop element runs transversely to this guide channel and is formed by a rib 20 projecting from an essentially prismatic guide body 19. Its distance from the removal end of the guide channel is selected in such a way that the frontmost heald LI1 bearing against the rib 20 is located completely outside the guide channel. The distance between rib 20 and guide channel is adjustable; the adjustment is preferably made by exchanging the guide body 19, various guide bodies 19 being available in which the stop surface of the ribs 20 is in each case stepped to varying degrees from the corresponding base surface of the guide body 19. In practice, three to four guide bodies 19 of this type are sufficient to cover the entire range of the heald thicknesses which occur.

The frontmost heald LI1 therefore lies in the area of the rib 20 outside the guide channel but is still held with its end lugs on the rails 13. The separation is now effected, that is, the separation of the frontmost heald LI1 from the heald stack LS, for which purpose the center part (i.e., the part lying between the end lugs) of the frontmost heald LI1, is pushed laterally out of the heald stack. This pushing-out is effected by a piston-like selecting member 21 which is mounted in the guide body 19 so as to be adjustable in its stroke transversely to the longitudinal direction of the healds LI and transversely to their guide direction A. During its working stroke in the direction of arrow C (the transverse direction) the selecting member 21 pushes the center part of the frontmost heald LI1 away from the heald stack LS in a positive-locking manner into the intermediate position ZP drawn in broken lines. During this displacement, the said center part slides along a guide plane 22 until it comes to a stop at a stop 23. In the intermediate position ZP, the heald is held at its end lugs by the rails 13 and in the area of its center part between the stop 23 and the front edge of the selecting member 21.

A plunger 24 displaceable in the direction of arrow D is arranged below the guide plane 22, the end face of which plunger 24 is set back slightly relative to the guide plane 22 against the direction of arrow D. The plunger 24 is now moved in arrow direction D and displaces the center part of the heald LI1 from the intermediate position ZP on an inclined path parallel to the inclined end face of the rib 20 into a transfer position UP drawn in chain lines. During this displacement produced by the plunger 24, the heald center part bent during the separation relaxes again and assumes its straight position again in the transfer position UP. If the transfer position UP is compared with the initial position before the separation, only a displacement in the transport direction A has taken place between these two positions indirectly via the intermediate position ZP, the heald being guided in a positive-locking manner during the entire displacement.

In the transfer position UP, the heald is no longer held with its end lugs by the rails 13 but is slipped over needle-like holding means 25 which form part of a transport unit for transporting the heald to the drawing-in position. The plunger 24 is then moved back into its initial position, and the selecting member 21, already moved back into its initial position against the direction of arrow C during the transport stroke of the plunger 24, can perform a further working stroke and as a result separate the next heald LI from the heald stack LS.

Figure 7:
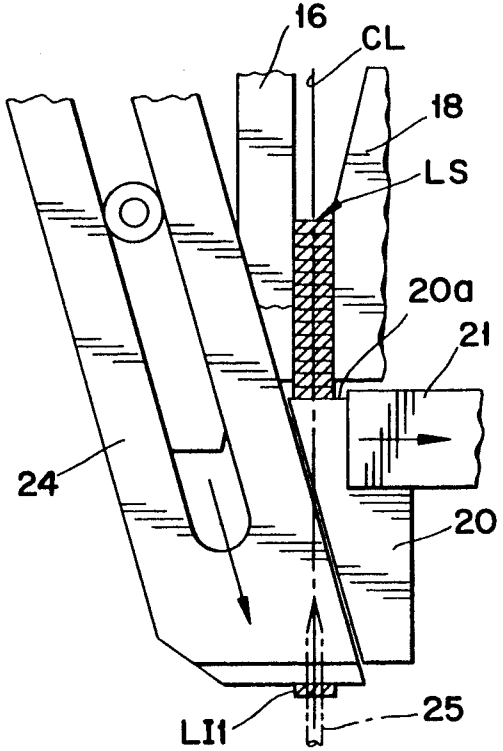
FIG. 7 is another view similar to FIGS. 5 and 6, but showing the parts in the positions they occupy after a separated heald has been transferred from the intermediate position of FIG. 6.
Figure 6:
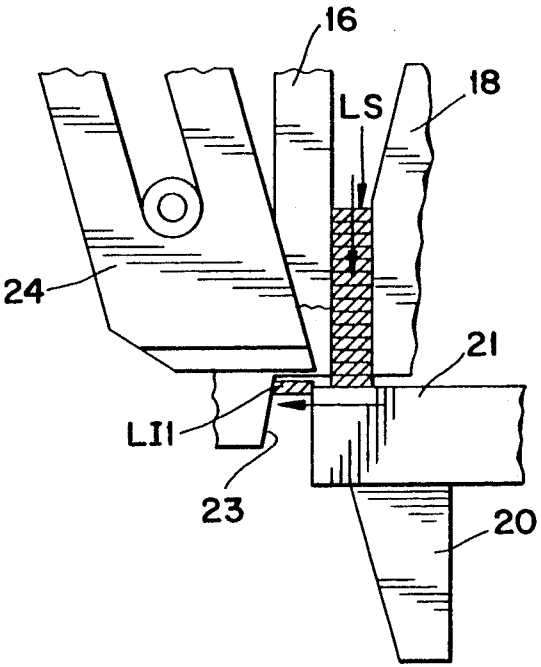
FIG. 6 is a view similar to FIG. 5 but showing the parts in the positions they occupy after a portion of the endmost heald of the heald stack has been shifted laterally of the stack.
Figure 5:
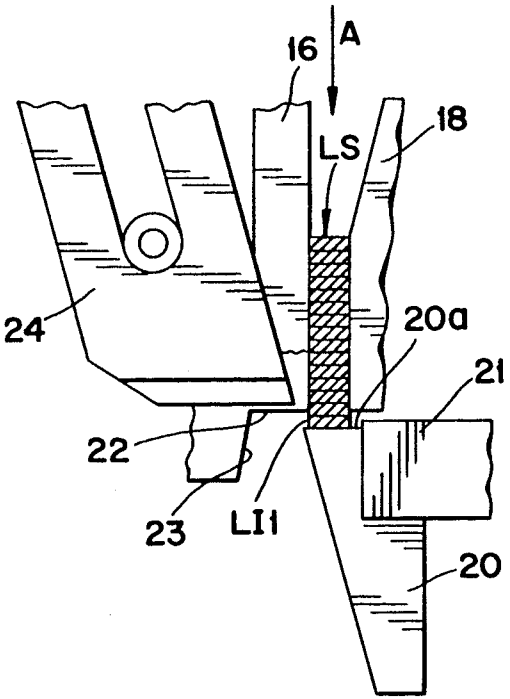
FIG. 5 is a somewhat diagrammatic view generally similar to FIG. 4 with some parts omitted and showing on an enlarged scale the relationships between certain parts of the heald singularizing system of the invention.

Some relationships involved in the heald selection and transfer operations are depicted in FIGS. 5–7. These are a sequence of similar views from above of the heald selecting and transferring components of the lower separating stage SP (FIG. 3).

The front portion of the heald stack LS is shown within the guide channel formed by the rails 16 and 18 and should be understood to be yieldingly urged (as by a brush roller 17) toward a stop surface 20*a* provided by the guide body/rib unit 19,20. The guide surface 22 is at the removal end of the guide channel for the stack LS and is spaced from the stop surface 20*a* in a direction parallel to the direction of movement of the stack LS along the channel. This spacing is greater than one heald thickness but less than two heald thicknesses.

The end of piston-like selecting member 21 has a portion (its upper portion in FIG. 5) that extends in the space between the stop surface 20*a* and the end of the guide channel for the stack LS. The protrusion of the member 21 beyond the stop surface 20*a* is less than the thickness of one heald. This enables the end face of the selecting member 21 to push against the edge face of the endmost heald LII without contacting any other heald when the member 21 is moved to the left in FIG. 5 over the guide body/rib unit 19, 20.

The movement or stroke of the selecting member 21 is long enough to displace the contacted portion of the endmost heald 21 laterally beyond the nose or tip of the rib 20. This relationship will be evident from a comparison of FIGS. 5 and 6. In its laterally displaced condition, this heald is no longer constrained by the guide body/rib unit 19, 20 from further motion in the direction A of movement of the heald stack LS.

The plunger 24 then is activated to shift this heald forwardly. As the plunger 24 moves in its inclined path, its end face pushes the displaced heald portion forwardly beyond the nose of the rib and then along the inclined side face of the rib. Retraction of the selecting member 21 (as indicated in FIG. 7) frees the displaced heald portion from the biasing force and allows this heald to return to its natural straight condition.

FIG. 3, partly in section, shows a true-to-scale representation of the two separating stages SP and their arrangement. FIG. 4 also is partly in section and shows a true-to-scale representation. Each separating stage SP is fixed to a support 26, of which only the one for the top separating stage is drawn in the figure. The selecting member 21, which is carried by a pneumatically driveable piston 27, will be recognized on the right hand side of the heald LI in FIG. 3. The piston 27 is mounted in a housing 28 provided with compressed-air connections. The selecting member 21 is guided in the guide body 19, and a stop pin 29 passes through it for limiting its stroke. In the area of its front part for separating the heald LI, the selecting member is of U-shaped design and surrounds the rib 20.

Recognizable on the left hand side of the heald LI in FIG. 3 are first and second components 30 and 34, as well as the guide rail 16. The first component 30 includes a basic body 31 fixed to the support 26. A sensor 32 is fixed to this basic body 31 and has a contact spring 33 (see FIG. 4). The second component 34 is likewise fixed to the support 26 and provides the guide plane 22 and the stop 23. The sensor 32 serves to detect the heald separation by the contact spring 33 being pressed against the sensor 32 by the heald LI during its displacement into the intermediate position ZP. In general, it can be said that the movement of the selecting member 21 and the movement of the plunger 24 also are monitored by sensors. If one of these sensors does not respond, the relevant function is repeated.

The plunger 24 also is pneumatically operable. Its arrangement is indicated in FIG. 4, but the plunger 24 has been omitted from FIG. 3 for the sake of clarity. The plunger 24 for each of the separating stages SP is arranged on the inside of the two separating stages, that is, below the top separating stage SP and above the bottom separating stage SP. According to the representation, the longitudinal axis of the essentially prismatic plunger 24 lies at an angle to the feed direction A of the healds LI. Its end face contacting the healds LI runs at an angle to the longitudinal axis, or in other words parallel to the longitudinal axis of the selecting member 21 (arrow C). The plunger 24 has an elongated slot 40 which surrounds a bolt 41 serving to guide it during its stroke movement. A pneumatically driveable piston 43 mounted in a piston housing 42 serves to drive the plunger 24.

Since the selecting members 21 of the upper and lower separating stages SP act on each heald in its top and bottom areas and since the heald eyes LA (FIG. 3) are located in the mid-portions of the lengths of the healds so as to have a relative large distance from the selecting members 21, it can happen that a heald is singularized from the stack at its top and bottom areas but still adheres to the following heald at the heald eye region.

When such a singularized heald is then transferred to the holding means 25 by the plunger 24 (over a distance of approximately 25 millimeters), the two healds adhering together at their eyes will have at their ends a mutual distance of 25 mm. They will look like two convex curves facing each other and being in contact at their vertex.

In order to separate two healds adhering together in this manner, a finger 37 is located to swing in a vertical plane between the front end of the heald stack and the holding means 25. The finger is operated after the transfer of the heald to the holding means 25.

As shown in FIG. 3, suitable means for actuating the finger 37 may be located to cooperate with the other components. A further piston housing 35 is fixed to the support 26. A pneumatically driveable piston 36 is mounted in housing 35. This piston is connected in an articulated manner to the blade-like pivoted lever 37 which is pivoted into the plane of the healds LI when the piston 36 is actuated so that healds possibly adhering to one another at the heald eyes LA can be mechanically detached from one another. The traverse of the pivoted lever 37 is limited by suitable stop means selected in relation to the lengths of the healds being processed. There is a stop 38 whose position is suitable for the maximum length of the healds LI used. Where shorter healds are to be removed, as indicated in FIG. 3, the active stop means may be in the form of an additional stop pin 39 (drawn in chain lines) mounted on the support 26 in order to limit the traverse of the pivoted lever 37 to the upper of the two end positions shown in chain lines.

The arc through which the finger 37 swings amounts according to FIG. 3 (upper of the two end positions drawn in chain lines) to approximately 70°. For longer healds where the lower separating station would be in a lower position than that shown in FIG. 3, the arc would amount to 90° but in both cases the finger 37 would not encounter interference from other structural components.

The described system for singularizing the healds preferably is such that the entire arrangement, that is, the separating stages together with the heald supporting rails and the transport means for feeding the healds, is mounted on a common mounting stand. This mounting stand is of mobile construction and can thus be moved into the warp thread drawing-in machine in a simple manner.

There is a detachable connection in the form of a locking coupling between the device for singularizing the healds and the following transport unit for transporting the healds to their drawing-in position. The various functions of the individual parts, such as selecting member 21, plunger 24 and pivoted lever 37, are separately controlled; and the various functional sequences are synchronized via the module computer of the heald module.

What is claimed is:

1. Apparatus for singularizing healds for warp-thread drawing-in machines, having a selecting member for the healds fed in the form of a stack, which selecting member separates the healds from the stack and makes them available for the drawing-in of the warp threads, wherein the selecting member (21) is formed by a piston which can perform a stroke essentially transversely to the heald stack (LS), said piston being positioned so that during the working stroke (arrow C) of the piston, the heald (LI1) adjacent to the piston is transported transversely from the heald stack in positive-locking manner into an intermediate position (ZP).

2. Apparatus according to claim 1, wherein a transfer means (24) for transferring the respective heald (LI1) to a transport unit (25) for transporting the healds to their drawing-in position is provided in the said intermediate position (ZP).

3. Apparatus according to claim 2, including heald supporting rails in which the healds are hung with their end lugs, wherein the healds (LI) are hung in the heald supporting rails (13) during the selection by means of the selecting member (21).

4. Apparatus according to claim 3, wherein the healds (LI) are hung in the heald supporting rails (13) during the transfer by the transfer means (24) and are released from the heald supporting rails only during the transfer to a transport unit (25).

5. Apparatus according to claim 1, wherein two separating stages (SP) are provided, of which each has a selecting member (21) and acts on one of the two heald halves.

6. Apparatus according to claim 5, including guide and transport means for feeding the healds (LI) to the separating stages (SP), the guide means being formed by guide rails (16, 18) which are arranged on either side of the heald stack (LS) and form a guide channel.

7. Apparatus according to claim 6, wherein the transport means are formed by rotatable members acting on one narrow side of the heald stack (LS), preferably by rollers (17) having a brush-like lining and/or by conveying belts provided with brushes.

8. Apparatus according to claim 6, including a stop (20) arranged at the front end of the guide channel (16, 18) facing the separating stage (SP), the distance of which stop (20) from the guide channel is greater than a single heald thickness and less than twice the thickness of a heald (LI1) to be separated.

9. Apparatus according to claim 8, wherein the stop (20) is formed by a rib made on a guide body (19) for the selecting member (21), and in that the selecting member surrounds the rib in a U-shape at its end contacting the heald (LI1).

10. Apparatus according to claim 9, including a guide surface (22) for the heald, which guide surface (22) is arranged on the side of the heald (LI1) remote from the rib (20) and adjoins the front end of the guide channel (16, 18) and along which the heald is guided during the working stroke of the selecting member (21) and which is limited by a surface (23) for the heald, which surface (23) defines the said intermediate position (ZP).

11. Apparatus according to claim 10, including sensor means (32, 33) for detecting the point at which the heald (LI1) reaches the intermediate position (ZP), said sensor means including a flexible member (33) which contacts a opposing element (32) when the heald strikes against the stoppage (23).

12. Apparatus according to claim 4, wherein said transfer means (24) is formed by a plunger adjustable in its stroke in the transport direction (A) of the heald stack (LS) or at an angle to this transport direction (A).

13. Apparatus according to claim 2, wherein said transport unit has needle-shaped holding means (25) over which end lugs on the heald (LI1) may be slipped.

14. Apparatus according to claim 6, including the needle-shaped holding means (25) in alignment with the axis of the guide channel (16, 18).

15. Apparatus according to claim 5, including a detaching member for detaching healds possibly adhering to one another, said detaching member having a detaching blade (37) pivotable into the plane of the healds between the two separating stages (SP).

16. Apparatus according to claim 15, wherein said detaching blade (37) is mounted at one of its ends about a pivot axis and is connected in an articulated manner to a drive means (36) adjustable in its stroke.

17. Apparatus according to claim 16, wherein said selecting member (21), said plunger (24) and said drive means (36) for the detaching blade (37) are each driven by a pneumatically operable piston.

18. Apparatus according to claim 6, wherein the separating stages (SP), the heald supporting rails (13) and the transport means (17) for feeding the healds (LI) are mounted on a common mounting stand.

19. Apparatus according to claim 18, wherein the common mounting stand is designed as a displaceable truck and is detachably coupled to the functional stage of the warp-thread drawing-in machine containing the transport unit.

20. A method of singularizing healds in preparation for the drawing-in of warp threads, said healds being of a type in which thin, flat, elongated strips are provided with thin, flat, enlarged lugs at their end portions, said method comprising disposing a supply of said healds in face-to-face relation in a stack biased for movement in a direction generally transverse to both the lengths and the abutting faces of the healds, providing a stop for limiting movement of said stack in said direction, displacing a portion of the endmost heald of said stack in contact with said stop laterally out of said stack and beyond said stop, and transferring the laterally displaced heald portion forwardly relative to said stack.

21. Apparatus for singularizing healds from a stack of face-to-face healds in preparation for drawing warp threads into the respective singularized healds, comprising means for supporting a stack of healds for movement in a direction generally transverse to both the lengths and the abutting faces of the individual healds;

a stop for limiting movement of said stack in said direction of stack movement; and piston means movable back and forth at an angle to said direction of stack movement for contacting the lateral edge of only the endmost heald of said stack in contact with said stop to displace the contacted heald portion laterally of said stack and beyond said stop.

22. Apparatus according to claim 21, including means for urging said stack in said direction to press the endmost heald of the stack against said stop.

23. Apparatus according to claim 21, wherein said supporting means supports at least one end portion of each of said healds and wherein said piston means contacts another portion of said endmost heald while an end portion of said endmost heald is supported by said supporting means.

24. Apparatus according to claim 21, wherein said supporting means is in the form of elongated rails received in openings in opposite end portions of said healds, and wherein said piston means deflects an intermediate portion of said endmost heald out of alignment with said stack while said rails are disposed in the end portions of such endmost heald.

25. Apparatus according to claim 24, additionally including transfer means movable at an angle to the direction of movement of said piston means to contact said endmost heald and shift said endmost heald on said rails in the direction of the length of said stack after said intermediate portion has been deflected beyond said stop by the action of said piston means.

26. Apparatus according to claim 21, additionally including transfer means movable at an angle to the direction of movement of said piston means to contact said endmost heald to shift said endmost heald along said supporting means after said piston means has displaced a portion of said endmost heald beyond said stop.

27. Apparatus according to claim 21, wherein said supporting means is in the form of elongated rails received in opposite end portions of said healds; wherein said stop and said piston means are located between the mid-point and a first end portion of said endmost heald; and wherein said apparatus comprises additionally a second stop for limiting movement of said stack in said direction of stack movement, and second piston means movable back and forth along a line at an angle to said direction of stack movement for contacting the lateral edge of only the endmost heald of said stack in contact with said second stop to displace the contacted heald portion laterally in the same direction as the first mentioned piston means and beyond said second stop, said second stop and said second piston means being located between the mid-point and a second end portion of said endmost heald.

28. Apparatus according to claim 27, additionally comprising detaching means movable into the space between said endmost heald and the adjacent heald in the stack at a zone between the two said piston means.

* * * * *